US009831596B1

(12) United States Patent
Simas

(10) Patent No.: US 9,831,596 B1
(45) Date of Patent: Nov. 28, 2017

(54) FLAME-PROOF CONNECTORS

(71) Applicant: ITT Manufacturing Enterprises LLC, Wilmington, DE (US)

(72) Inventor: Taylor Michael Simas, Santa Rosa, CA (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 0 days.

(21) Appl. No.: 15/440,658

(22) Filed: Feb. 23, 2017

Related U.S. Application Data

(60) Provisional application No. 62/440,020, filed on Dec. 29, 2016.

(51) Int. Cl.

| | |
|---|---|
| ***H01R 13/53*** | (2006.01) |
| ***H01R 13/527*** | (2006.01) |
| ***H01R 24/38*** | (2011.01) |
| ***H01R 13/622*** | (2006.01) |
| ***H01R 13/631*** | (2006.01) |
| *H01R 101/00* | (2006.01) |

(52) U.S. Cl.
CPC ..... *H01R 13/527* (2013.01); *H01R 13/622* (2013.01); *H01R 13/631* (2013.01); *H01R 24/38* (2013.01); *H01R 2101/00* (2013.01)

(58) Field of Classification Search
CPC .... H01R 13/527; H01R 24/38; H01R 13/631; H01R 13/622; H01R 2101/00
USPC ..... 439/183
See application file for complete search history.

(56) References Cited

U.S. PATENT DOCUMENTS

| | | | |
|---|---|---|---|
| 2,735,993 | A | 2/1956 | Humphrey |
| 2,824,290 | A | 2/1958 | Archer et al. |
| 2,892,991 | A | 6/1959 | Beebee et al. |
| 2,933,712 | A | 4/1960 | Klopfenstein |
| 3,360,763 | A | 12/1967 | Rongey et al. |
| 3,422,390 | A | 1/1969 | Tucker |
| 3,455,580 | A | 7/1969 | Howard |
| 3,576,517 | A | 4/1971 | Jonson et al. |
| 3,659,250 | A | 4/1972 | Horton |
| 3,786,396 | A | 1/1974 | Kemmer et al. |
| 3,808,579 | A | 4/1974 | Mina et al. |
| 3,888,559 | A | 6/1975 | Geib |
| 4,017,139 | A | 4/1977 | Nelson |

(Continued)

FOREIGN PATENT DOCUMENTS

DE 3212541 C2 5/1985

*Primary Examiner* — Jean F Duverne
(74) *Attorney, Agent, or Firm* — Knobbe Martens Olson & Bear LLP

(57) ABSTRACT

Various electrical connector assemblies are disclosed. The electrical connector assembly can include a pin and a socket. An outer surface of the pin can have an external thread and an annular groove that has an outside diameter that is less than an outside diameter of an adjacent leading flange. The socket can have an internal thread that mates with the external thread on the pin. The connector can comprise independent securing features, such as a threaded connection and a ball detent connection. The connector can be configured such that disengagement of the first connection feature results in disconnection of mating electrical contacts of the pin and socket. In some variants, the second connection feature remains engaged and/or is disengaged independently of the first connection feature.

20 Claims, 10 Drawing Sheets

(56) References Cited

U.S. PATENT DOCUMENTS

| | | | | |
|---|---|---|---|---|
| 4,094,567 | A | 6/1978 | Karcher et al. | |
| 4,120,552 | A | 10/1978 | Winkler et al. | |
| 4,407,529 | A | 10/1983 | Holman | |
| 4,516,821 | A | 5/1985 | Nieman | |
| 4,582,347 | A | 4/1986 | Wilcox et al. | |
| 4,605,271 | A | 8/1986 | Burns | |
| 4,620,760 | A | 11/1986 | Duncan | |
| 4,793,821 | A | 12/1988 | Fowler et al. | |
| 4,812,670 | A * | 3/1989 | Goulet | B60R 25/045 180/283 |
| 5,129,837 | A | 7/1992 | Williams | |
| 5,388,874 | A | 2/1995 | Barrier | |
| 5,690,503 | A | 11/1997 | Konda et al. | |
| 5,702,264 | A | 12/1997 | Endo et al. | |
| 5,807,129 | A | 9/1998 | Konda et al. | |
| 5,980,288 | A | 11/1999 | Jarvis | |
| 5,984,709 | A | 11/1999 | Zink et al. | |
| 5,997,333 | A | 12/1999 | Konda et al. | |
| 6,022,237 | A | 2/2000 | Esh | |
| 6,062,891 | A | 5/2000 | Villiers | |
| 6,135,799 | A | 10/2000 | Lincoln | |
| 6,609,427 | B1 | 8/2003 | Westfield et al. | |
| 6,623,289 | B2 | 9/2003 | Decicco | |
| 6,655,991 | B2 | 12/2003 | Heebe et al. | |
| 6,716,048 | B2 | 4/2004 | Collin et al. | |
| 6,761,588 | B2 | 7/2004 | Heebe et al. | |
| 6,824,415 | B2 | 11/2004 | Wlos | |
| 6,875,037 | B2 | 4/2005 | Collin et al. | |
| 6,877,277 | B2 | 4/2005 | Kussel et al. | |
| 7,871,279 | B2 | 1/2011 | Litteer | |
| 8,435,061 | B2 | 5/2013 | Ijima | |
| 8,771,002 | B2 | 7/2014 | Chiu et al. | |
| 9,203,182 | B2 | 12/2015 | Fawcett | |
| 2003/0075319 | A1* | 4/2003 | Chau | E21B 7/046 166/65.1 |
| 2004/0073195 | A1* | 4/2004 | Cucin | A61B 17/32002 604/542 |
| 2004/0087198 | A1 | 5/2004 | Decicco | |
| 2010/0331873 | A1* | 12/2010 | Dannaher | A61B 17/320092 606/169 |
| 2012/0116261 | A1* | 5/2012 | Mumaw | A61B 17/00234 601/2 |

* cited by examiner

FLAME-PROOF CONNECTORS

BACKGROUND

Field

The present disclosure relates to methods and devices related to an improved electrical connector and, in particular to a quick assembly flame-proof connector.

Description of Certain Related Art

Electrical connectors can connect a contact pin with a socket to establish an electrical connection between the pin and socket. In certain arrangements, an electrical connector can be a reversible coupling that allows the connection and disconnection of the contact pin and the socket.

SUMMARY OF CERTAIN FEATURES

Electrical connectors (also referred to herein as "connectors") can be used in certain environments where a flammable material is present. For example, electrical connectors can be used in energy extraction operations in which a flammable gas surrounds the connector. An electrical arc or spark can be formed during the coupling or de-coupling of the contact pin and the socket. The spark can ignite gases surrounding the contact pin and socket. A flame-proof connector can contain the spark within the connector, thereby preventing ignition of gases outside of the connector.

Some flame-proof connectors require several (e.g., five) threads to be engaged upon the connection or disconnection of the contact pin from the socket. Several threads of engagement can prevent a flame from propagating out of the connector if a spark arcs between the contact pin and socket. Having five threads engaged when the pin and socket are coupled or decoupled can also allow the engaged threads to keep the portions of the connector together should an explosion occur within the connector during the coupling or decoupling of the pin and socket. In this way, several threads of engagement can prevent an explosion within the connector from causing an explosion outside of the connector.

A problem with connectors that have several (e.g., five) threads engaged upon the connection or disconnection of the contact pin from the socket is that such connectors can have a long threaded interface. This requires multiple turns to safely remove the connector. Uncoupling such a connector can be inconvenient and/or time consuming (e.g., can take several minutes), such as when installed in areas with limited space.

As discussed in more detail below, some embodiments of the present disclosure relate to electrical connector assemblies adapted to provide a flame extinguishing path and a second form of retention in case of explosion. In certain aspects, the assembly includes a threaded engagement that is readily and/or quickly engaged or disengaged. For example, the assembly can include a steep pitch, multiple start thread that facilitates unmating and/or disconnecting the pin from the socket. The assemblies can be arranged to inhibit or prevent the flame path from propagating outside of an internal chamber and/or from causing an external explosion. The second form of retention can inhibit or prevent complete disconnection of the pin and the socket in case of an internal explosion. A second action can be required to enable disconnection of the connector assembly. In certain arrangements, the second action is the sliding of a spring-loaded coupling nut. In various embodiments, the assemblies can be rapidly disconnected. For example, in some embodiments, the assemblies can be disconnected in less than or equal to about 20 seconds.

BRIEF DESCRIPTION OF THE DRAWINGS

Various embodiments are depicted in the accompanying drawings for illustrative purposes, and should not be interpreted as limiting the scope of the embodiments. Furthermore, any features, structures, components, materials, and/or steps of different disclosed embodiments can be combined to form additional embodiments, which are part of this disclosure.

DETAILED DESCRIPTION OF CERTAIN EMBODIMENTS

Figure 1:
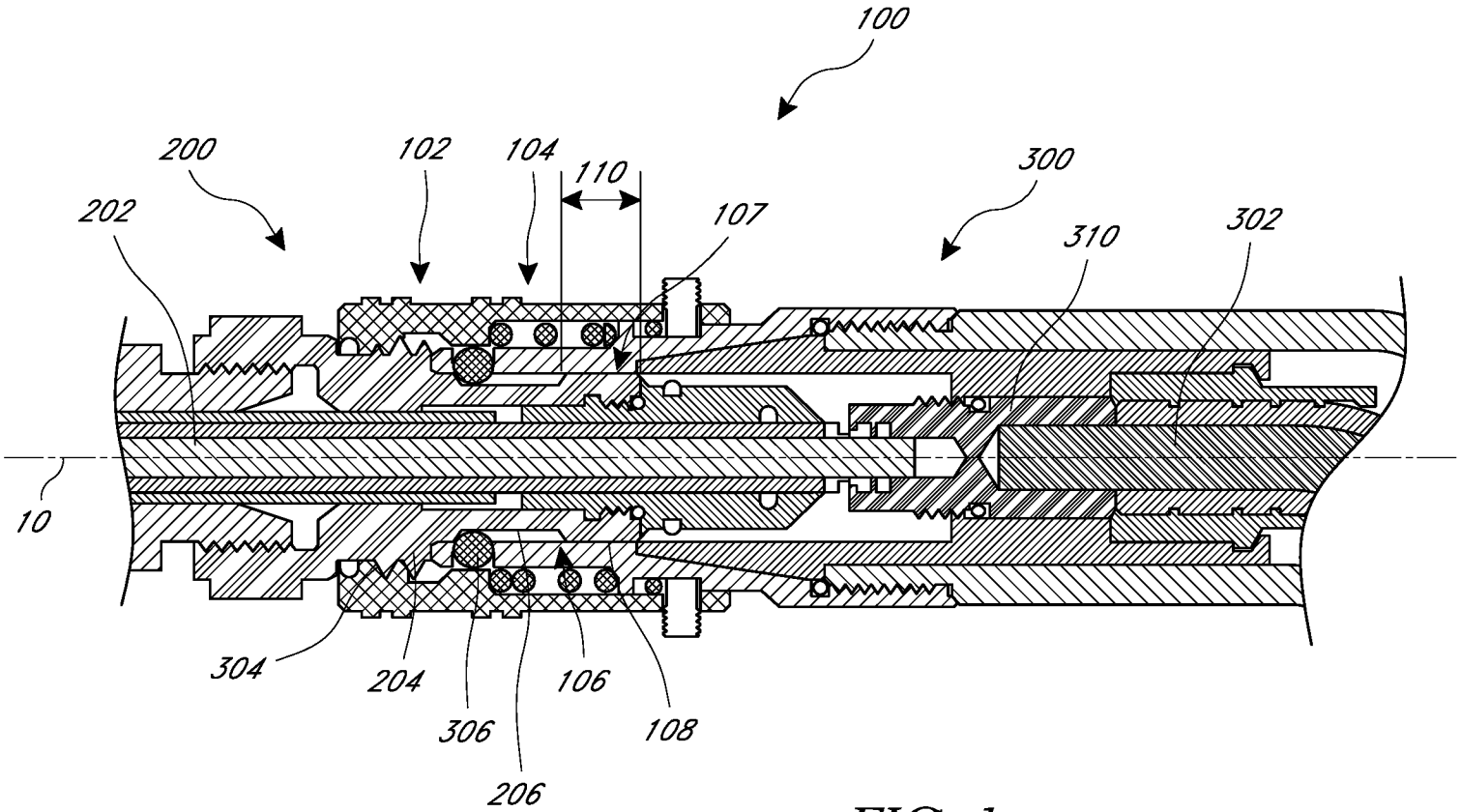
FIG. 1 is a side cross-sectional view of an embodiment of an electrical connector assembly comprising a socket and a pin.

In the following detailed description, reference is made to the accompanying drawings, which form a part hereof. In the drawings, similar reference numbers typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. The aspects of the present disclosure, as generally described herein, and illustrated in the figures, may be arranged, substituted, combined, and designed in a wide variety of different configurations, all of which are explicitly contemplated and made a part of this disclosure.

Overview

FIG. 1 shows a cross-sectional side view of an illustrative, non-limiting example of an electrical connector assembly 100. The electrical connector assembly 100 can be made up of a collection of components. Some or all of the components may be pre-assembled with one another, as discussed in more detail below. In some embodiments, the electrical connector assembly 100 includes a pin 200 and a socket 300. The pin 200 can include a pin conductor 202, and the socket 300 can include a socket conductor 302. The electrical connector assembly 100 can connect the pin 200 and the socket 300 to establish an electrical connection between the pin conductor 202 and the socket conductor 302. The electrical connector assembly 100 can include an interface unit 310 that helps form an electrical connection between the pin conductor 202 and the socket conductor 302, as described in more detail below. The electrical connector assembly 100 can have a longitudinal axis 10 that extends along a central line of the pin conductor 202, as shown in FIG. 1.

As discussed below, the electrical connector assembly 100 can include features that eliminate the need for several (e.g., at least: four, five, or more) threads of engagement. Certain implementations include a first retention feature that aids in containing a flame and a second retention feature that aids in inhibition or prevention of an explosion outside of the connector. As shown in FIG. 1, the electrical connector assembly 100 can have a contact coupling 102 and a safety interlock 104. The contact coupling 102 can connect and disconnect the pin 200 and the socket 300. For example, the contact coupling 102 can comprise a threaded connection of the pin 200 and the socket 300. The safety interlock 104 can limit relative movement between the pin 200 and the socket 300. For example, the interlock 104 can comprise a sleeve that slides to permit or inhibit relative movement of the pin 200 and the socket 300.

The electrical connector assembly 100 can include a flame-extinguishing path 106. The flame-extinguishing path 106 can define a flow pathway that extinguishes a flame inside the connector assembly 100 and/or that cools the expanding gases of an explosion inside the connector assembly 100. In some embodiments, the flame-extinguishing path 106 is configured to enable the cooled gases to be discharged from the interior space of the connector assembly 100 into the surrounding environment. The flame-extinguishing path 106 can be configured such that the discharged cooled gases do not ignite flammable gases in the surrounding environment. The flame-extinguishing path 106 can communicate between the inside of the connector 100 and the outside of the connector 100. The flame-extinguishing path 106 can be a gap between the pin 200 and the socket 300. In the illustrated embodiment, the flame-extinguishing path 106 comprises a narrows 107, such as the annular flow path that is located between the outer surface of the pin 200 and the inner surface of the socket 300. The flame-extinguishing path 106 can further comprise a clearance that extends from the narrows 107 across the threads 204, 304.

The contact coupling 102, the safety interlock 104, and the flame-extinguishing path 106 can each have corresponding features on the pin 200 and socket 300. For example, the contact coupling 102 can comprise an external thread 204 on the pin 200 that mates with an internal thread 304 on the socket 300. The safety interlock 104 can comprise a ball bearing 306 located on the socket 300 that protrudes into a capture groove 206 located on the pin 200. The flame-extinguishing path 106 can comprise a clearance 108 that is formed between the pin 200 and the socket 300. While these features are described in the context of the non-limiting illustrative embodiments, the scope of the present disclosure includes other contact coupling, safety interlock, and flame-extinguishing features, as well as other orientations of the methods and devices disclosed herein. For example, the contact coupling 102 can include a pin-and-groove connection rather than the threaded connection shown in the illustrated embodiment.

In some embodiments, the contact coupling 102 can be adapted to perform a quick and simple connection or disconnection between the pin 200 and the socket 300. The contact coupling 102 can have an engaged position and a disengaged position. When the contact coupling 102 is in the engaged position, the pin 200 and the socket 300 can be secured together and/or can form an electrical connection with one another. When the contact coupling 102 is in the disengaged position, the pin 200 and the socket 300 can be disconnected from one another. In certain arrangements, the contact coupling 102 can move the pin 200 and the socket 300 toward one another when the contact coupling 102 moves from a disengaged state to an engaged state. For example, in the illustrated embodiment the contact coupling 102 can include an external thread 204 that mates with an internal thread 304.

In some embodiments, the contact coupling 102 does not perform a flame-extinguishing function. This can enable the use of securement features that can be more convenient to use. For example, the external thread 204 can be a steep pitch thread (e.g., a triple start thread) that allows for quick and simple final engagement of the pin 200 with the socket 300. The pitch of the external thread 204 can be sized to produce an axial movement of about 0.25 inches per rotation of the external thread 204. In some arrangements, the pitch of the external thread 204 can be sized to produce an axial movement of about 0.50 inches per rotation of the external thread 204. In some embodiments, the threads 204, 304 are configured to disengage in less than or equal to about: one turn, two turns, or three turns.

In certain implementations, the contact coupling 102 can move the pin 200 away from the socket 300 as the contact coupling 102 is moved from an engaged position to a disengaged position. For example, unthreading the external thread 204 from the internal thread 304 can allow for quick and simple disconnection of the pin 200 and the socket 300. In various embodiments, disengagement (e.g., unthreading) of the threads 204, 304 automatically disengages (e.g., spaces apart) the pin conductor 202 and the interface unit 310, thereby breaking the electrical communication. In some embodiments, the unthreading of the threads 204, 304 moves the pin conductor 202 out of the interface unit 310.

The safety interlock 104 can be engaged during certain parts of the connection and disconnection process of the pin 200 and the socket 300. In certain embodiments, the safety interlock 104 can serve as a retention mechanism. For example, in some embodiments, the interlock 104 can protect against an explosion inside the electrical connector assembly 100 from separating the pin 200 and the socket 300 and/or causing an external (outside of the connector) explosion. The safety interlock 104 can be engaged before the contact coupling 102 is moved from the disengaged position to the engaged position, or vice versa. For example, the electrical connector assembly 100 can be assembled by engaging the safety interlock 104 and moving the contact coupling 102 from the disengaged position to the engaged position, such as by threading the external thread 204 into the internal thread 304. To disassemble the electrical connector assembly 100, the contact coupling 102 can be moved from the engaged to the disengaged position, such as by unthreading the external thread 204 from the internal thread 304 and then the safety interlock 104 can be disengaged, such as by sliding the sleeve in order to release the ball 306 from the capture groove 206. After the contact coupling 102 and the safety interlock 104 have been disengaged, the pin 200 and the socket 300 can be separated (e.g., spaced apart).

The flame-extinguishing pathway 106 can be configured to contain a flame path and/or extinguish a flame inside the connector. The term "flame path" as used herein is intended to be given its customary meaning in the field of Explosion Proof or Flame Proof electrical devices. In other words, a flame path is a way for burning gases to exit from a device but only after such gases have been cooled off and their flames have been quenched. As shown in FIG. 1, the flame-extinguishing pathway 106 can include a narrows 107 adapted to quench flames and/or to cool of gases that cross the narrows 107. In the illustrated embodiment, the narrows 107 can be an annular flow path that is located between an external surface of the pin 200 and an internal surface of the socket 300. The narrows 107 can have a longitudinal length 110, as shown in FIG. 1. The narrows 107 can have a height bounded by the radial clearance 108 between the pin 200 and the socket 300. The dimensions of the flame-extinguishing pathway 106 and/or narrows 107 can be selected so that a flame and/or expanding gases from an explosion inside the connector 100 can exit the electrical connector assembly 100 and such gases are cooled and quenched of flame by the time the expanding gas exits the flame-extinguishing pathway 106. In some embodiments, the flame-extinguishing path way 106 is adapted so that the escaping flame cannot ignite gas or other materials surrounding the electrical connector assembly 100. For example, in the illustrated embodiment the flame-extinguishing pathway 106 can have a longitudinal length 110 that is at least a minimum of 0.25 inches and a radial clearance 108 that is a maximum of 0.002 inches when the ball bearing 306 is engaged in the capture groove 206.

Socket

Figure 2:
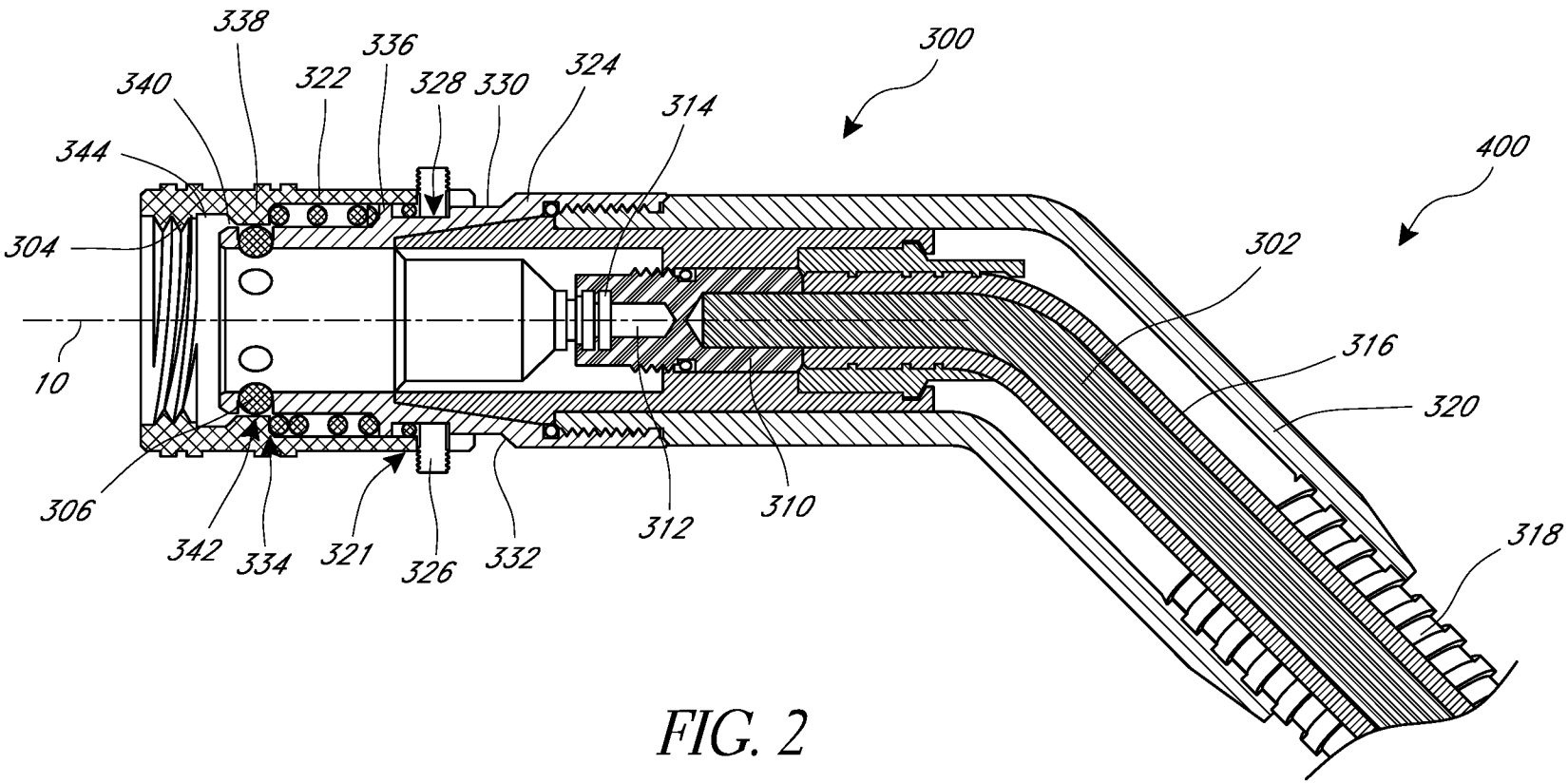
FIG. 2 is a side cross-sectional view of the socket shown in FIG. 1.

FIG. 2 shows a side cross-sectional view of the socket 300 shown in FIG. 1. The socket 300 can be attached to an end of a first electrical conduit 400, as shown in FIG. 2. The socket 300 can have an interface unit 310 that is attached to an end of the socket conductor 302. The interface unit 310 can have a port 312 that can receive a terminal portion of the pin conductor 202. The port 312 can be made of a material having a high electrical conductivity so that the port 312 establishes an electrical connection between the pin conductor 202 and the socket conductor 302 when the pin conductor 202 is inserted into the port 312. The socket 300 can include one or more connection facilitating elements, such as circular springs 314 arranged around the entrance of the port 312, as shown in FIG. 2. The circular springs 314 can be adapted to improve the electrical connection between the pin conductor 202 and the interface unit 310.

The socket conductor 302 can extend from the interface unit 310 into the first electrical conduit 400. The socket conductor 302 can be circumferentially surrounded by an insulating layer 316 that is disposed between the socket conductor 302 and an outer sheath 318 of the first electrical conduit 400. In some embodiments, the outer sheath 318 can be flexible. For example, in the illustrated embodiment, the outer sheath 318 has a corrugated form that allows the first electrical conduit 400 to bend. A terminal portion of the outer sheath 318 can be attached to a generally rigid knee 320, such as a metal conduit, as shown in FIG. 2.

The socket 300 can include a cuff 322 and a sleeve 324. In the illustrated embodiment, the sleeve 324 is threaded onto the rigid knee 320 at the end opposite of the flexible sheath 318. The cuff 322 and the sleeve 324 can surround the longitudinal axis 10, as shown in FIG. 2. The cuff 322 can circumferentially surround at least a portion of the sleeve 324. A set screw 326 can be inserted through a set screw hole 321 in the cuff 322 and into an annular groove 328 on the outer surface of the sleeve 324. When the set screw 326 passes through the set screw hole 321 and is seated in the annular groove 328, the cuff 322 can rotate about the longitudinal axis 10 but is inhibited or prevented from moving longitudinally along the longitudinal axis 10.

The sleeve 324 can have a neck 330 that extends from the annular groove 328 toward the knee 320. The neck 330 can connect to a shoulder 332 having an outer diameter that is greater than the outer diameter of the neck 330, as shown in FIG. 2. The outer dimension of the neck 330 can be less than the inner diameter of the portion of the cuff 322 that has the set screw hole 321. The outer dimension of the shoulder 332 can exceed the inner diameter of the portion of the cuff 322 that has the set screw hole 321. The cuff 322 can be configured to slide longitudinally over the neck 330 when the set screw 326 is removed from the set screw hole 321. The shoulder 332 can limit the extent to which the cuff 322 can slide toward the knee 320.

The socket 300 can include a biasing member, such as a spring 334. The spring 334 can circumferentially surround a portion of the sleeve 324 that extends into the cuff 322. As shown in FIG. 2, the spring 334 can be housed within a gap between the cuff 322 and the sleeve 324. One end of the spring 334 can rest against an outer flange 336 of the sleeve 324. The other end of the spring 334 can rest on an inner flange 338 of the cuff 322. The spring 334 can be loaded under compression and can push the outer and inner flanges 336, 338 away from one another. The sleeve 324 can have an end flange 340 that prevents the inner flange 338 from moving longitudinally past the end flange 340. When the set screw 326 is removed, the cuff 322 can be slid over the sleeve 324 toward the knee 320, thereby further compressing the spring 334.

As mentioned, the socket 300 can have one or more securing elements, such as one or more ball bearings 306. In some embodiments, the ball bearings 306 can extend toward the longitudinal axis 10 through apertures 342 in the sleeve 324. The inner flange 338 can align with the ball bearings 306 when the set screw hole 321 of the cuff 322 is aligned with the annular groove 328 of the sleeve 324, as shown in FIG. 2. The apertures 342 can have a diameter that is smaller than the diameter of the ball bearings 306, thereby preventing the ball bearings 306 from passing completely through the apertures 342. The inner flange 338 can prevent and/or inhibit the ball bearings 306 from exiting the apertures. In some embodiments, the inner flange 338 can be configured to keep the ball bearings 306 protruding through the apertures 342 toward the longitudinal axis 10 when the set screw hole 321 is aligned with the annular groove 328. In various embodiments, the ball bearings 306 are longitudinally fixed within the socket 300. For example, in some embodiments, the ball bearings 306 do not roll and/or slide longitudinally during connection and/or disconnection of the pin 200 and socket 300.

The inner surface of the cuff 322 can include a release feature, such as a groove 344. The release groove 344 can be adjacent to the inner flange 338 and/or on the opposite side of the inner flange 338 as the spring 334, as shown in FIG. 2. The cuff 322 can be arranged so that when the cuff 322 is slid over the neck 330 of the sleeve 324 to reach the neck 324, the release groove 344 aligns with the ball bearings 306. The radial distance of the release groove 344 from the longitudinal axis 10 can be selected so that the ball bearings 306 can be moved radially outward when the release groove 344 is aligned with the apertures 342. When the release groove 344 is not aligned with the apertures 342, a portion of the cuff 322, such as the inner flange 338, can push the ball bearings 306 radially inwardly and/or prevent or inhibit the ball bearings 306 from moving radially outwardly. The safety interlock 104 (shown in FIG. 1) of the electrical connector assembly 100 can be engaged when the inner flange 338 is longitudinally aligned with the ball bearings 306 and can be disengaged when the release groove 344 is aligned with the ball bearings 306.

Pin

Figure 3:
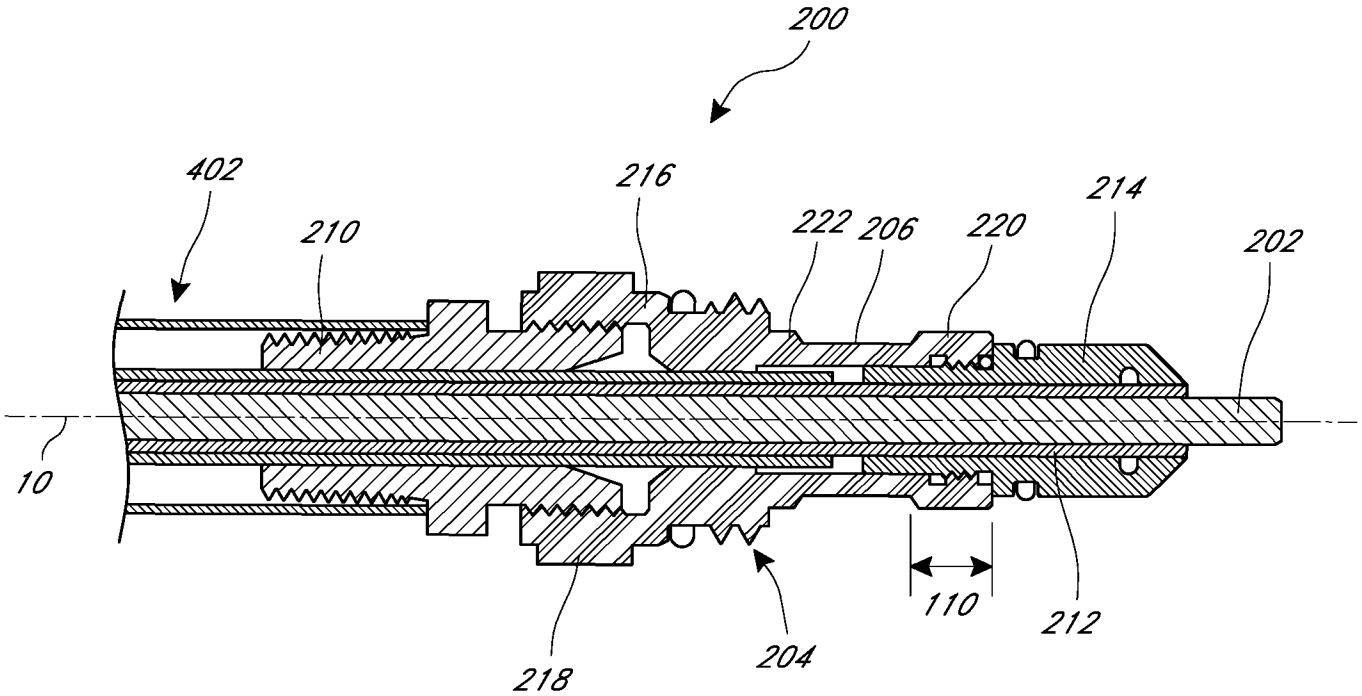
FIG. 3 is a side cross-sectional view of the pin shown in FIG. 1.

FIG. 3 shows a side cross-sectional view of the pin 200 shown in FIG. 1. The pin 200 can be attached to an end of a second electrical conduit 402, as shown in FIG. 3. The pin 200 can include a threaded fitting 210 that attaches the pin 200 to the end of the second electrical conduit 402. The pin conductor 202 (e.g., a solid wire) can extend from the second electrical conduit 402 through the pin 200. The pin conductor 202 can be circumferentially surrounded by an insulating layer 212 (e.g., a wire jacket). The pin conductor 202 can extend beyond a pin cap 214 that is attached to a pin housing 216. The pin housing 216 can include a tool dock 218 that can support the attachment of a tool (e.g., wrench) to the pin housing 216 to facilitate turning the pin 200. This can facilitate, for example, advancing the external thread 204 into the internal thread 304 of the socket 300 (shown in FIG. 1). As shown in FIG. 3, a portion of the pin housing 216 can include the external thread 204. In some variants, the pin housing 216 comprises other attachment features that achieve the function of the contact coupling 102, as described above.

In the illustrated embodiment, the pin housing 216 includes a capture groove 206. The groove 206 can be disposed between the external thread 204 and the pin cap 214. As discussed above, the capture groove 206 can be a part of the safety interlock 104. For example, the capture groove 206 can aid in securing the pin 200 to the socket 300 during the coupling or decoupling of the pin 200 and the socket 300. The capture groove 206 can be disposed between a leading flange 220 and a trailing flange 222, as shown in FIG. 3. The radial dimension of the capture groove 206 can be the distance of the outer surface of the capture groove 206 from the longitudinal axis 10. In various embodiments, the radial dimension of the capture groove 206 is less than that of the leading flange 220 and the trailing flange 222. The capture groove 206 can be recessed radially inward relative to the leading flange 220 and/or the trailing flange 222. For example, an outer diameter of the groove 206 can be less that an outer diameter of the leading flange 220. The radial dimensions of the capture groove 206, the leading flange 220, and/or the trailing flange 222 can be selected so that a portion of the ball bearings 306 (shown in FIG. 2) that protrudes from the apertures 342 can be received in the capture groove 206. In some embodiments, the portion of the ball bearings 306 is blocked from passing the leading or trailing flanges 220, 222, such as when the inner flange 338 of the cuff 322 is longitudinally aligned with the apertures 342, as described in more detail below with regard to FIG. 4.

As described above, the leading flange 220 can comprise a surface of the flow-extinguishing path 106. In some embodiments, the inner surface of the sleeve 324 provides another surface of the flow-extinguishing path 106 (see FIG. 1). The longitudinal length 110 of the leading flange 220 and the clearance 108 (shown in FIG. 1) between the pin 200 and the socket 300 can be selected to provide a flame-extinguishing path 106. In various embodiments, the flame-extinguishing path 106 is effective to render the electrical connector assembly 100 flame-proof and/or explosion proof. With reference to FIGS. 1-3, the clearance 108 of the narrows 107 of the flow-extinguishing path 106 can be set to a desired value by selecting the radial dimension of the outer surface of the leading flange 220 and the radial dimension of the inner surface of the sleeve 324. For example, in some variants, the clearance 108 is a maximum of about 0.002 inches.

Certain Methods Related to the Electrical Connector Assembly

Figure 4C:
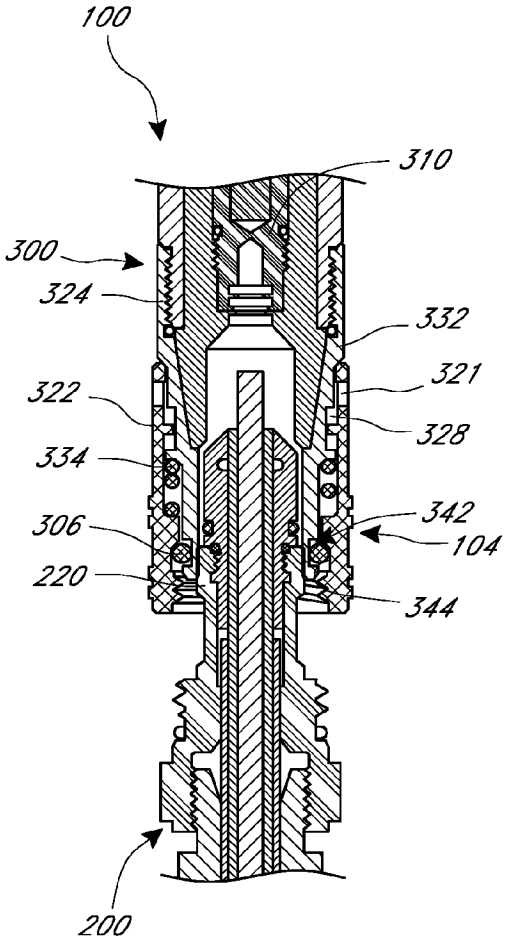
FIG. 4C is a side cross-sectional view of the electrical connector assembly of FIG. 1 in a second disengaged state.
Figure 4B:
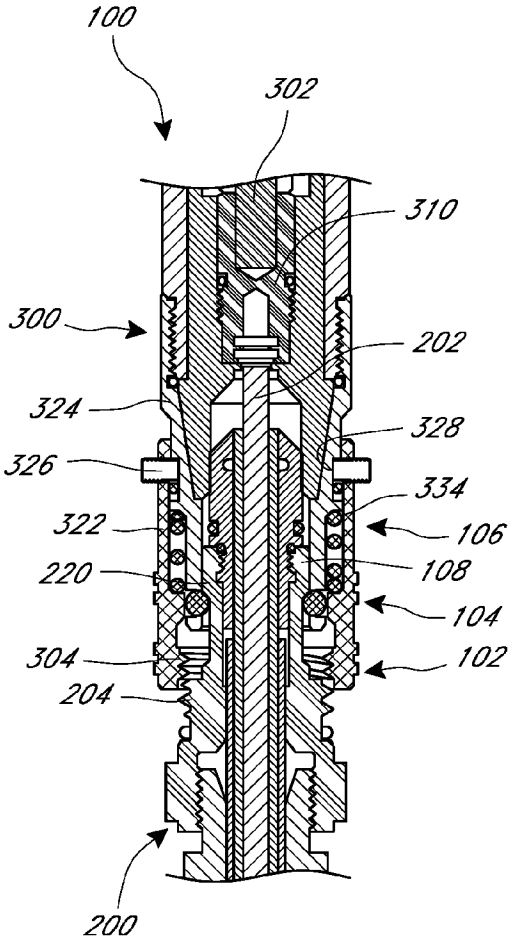
FIG. 4B is a side cross-sectional view of the electrical connector assembly of FIG. 1 in a first disengaged state.
Figure 4A:
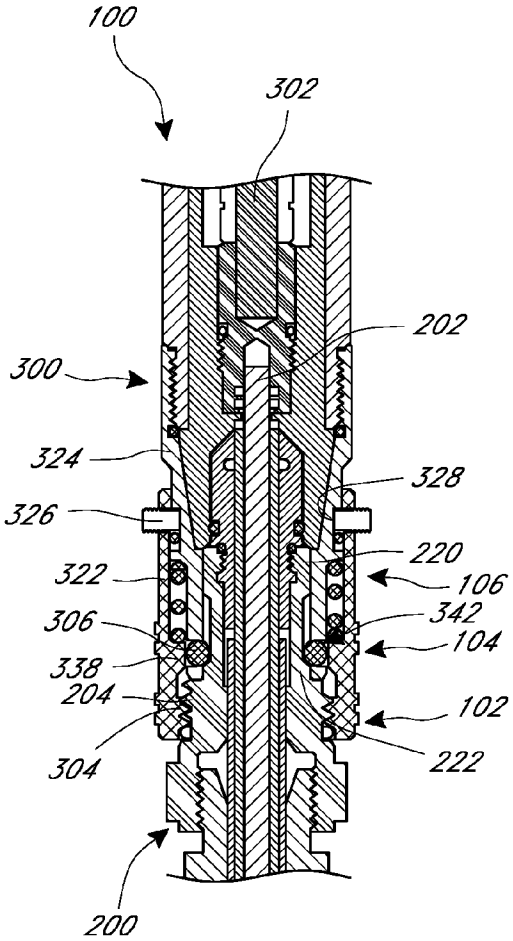
FIG. 4A is a side cross-sectional view of the electrical connector assembly of FIG. 1 in an engaged state.

With reference to FIGS. 4A-4C, a method of disconnecting the electrical connector assembly 100 will be described. In FIG. 4A, the embodiment of the electrical connector assembly 100 of FIG. 1 is shown in a first state (e.g., a connected position), with an electrical connection being established between the pin conductor 202 and the socket conductor 302. The contact coupling 102 is in an engaged position. For example, as shown, the external thread 204 of the pin 200 can be threadably engaged with the internal thread 304 of the socket 300. In some embodiments, this can bring the trailing flange 222 of the pin 200 near or into contact with inner portions of the ball bearings 306. This can, in some embodiments, halt further engagement of the threads 204, 304. In some variants, the external thread 204 and the internal thread 304 can be adapted to engage and/or be fully engaged before the trailing flange 222 engages the ball bearing 306. In some embodiments, the advancement of the external thread 204 can be stopped by reaching a termination of the internal thread 304 rather than by the trailing flange 222 colliding with the ball bearing 306.

In FIG. 4A, the safety interlock 104 is engaged. For the illustrated embodiment, this corresponds to the ball bearings 306 of the socket 300 extending into the capture groove 206 of the pin 200. The inner flange 338 of the cuff 322 keeps the ball bearings 306 seated in the apertures 342. The set screw 326 holds the cuff 322 longitudinally fixed relative to the sleeve 324.

With the electrical connector assembly in the position of FIG. 4A, the flame-extinguishing path 106 is in place to provide a fire-proof and/or explosion-proof connector, as described above. In the illustrated embodiment, the flame-extinguishing path 106 comprises a narrows 107, such as the annular flow path that is located between the leading flange 220 of the pin 200 and the inner surface of the portion of the sleeve 324 that circumferentially surrounds the leading flange 220. The flame-extinguishing path 106 can further comprise a clearance between the pin 200 and the socket 300 that extends to the environment outside of the connector 100. For example, the flame-extinguishing path 106 can further comprise a clearance that extends from the narrows 107 across the threads 204, 304. The flame-extinguishing path 106 can be a gap between the pin 200 and the socket 300. The flame-extinguishing path 106 can communicate between the inside of the connector 100 and the outside of the connector 100.

In FIG. 4B, the electrical connector assembly 100 is shown in a first disengaged state. In this state, the contact coupling 102 of the electrical connector assembly 100 has been disengaged, while the safety interlock 104 and the flame-extinguishing path 106 have remained engaged. In the illustrated embodiment, the contact coupling 102 can be moved to the first disengaged state by rotating the pin 200 relative to the socket 300 to unthread the external thread 204 of the pin 200 from the internal thread 304 of the socket. Unthreading the external thread 204 withdraws the pin conductor 202 from the interface unit 310 of the socket 300, thereby breaking the electrical connection between the pin conductor 202 and the socket conductor 302. In some embodiments, during the decoupling of the threads 204, 304, the set screw 326 remains seated in the annular groove 328 of the sleeve 324, which can inhibit and/or prevent the cuff 322 from moving longitudinally with respect to the sleeve 324. The annular groove 328 can be configured to allow the cuff 322 to rotate about the sleeve 324. In some embodiments, the pin 200 can be unthreaded from the socket 300 by rotating the cuff 322 portion of the socket 300 relative to the pin 200. In some embodiments, the pin 200 can be unthreaded from the socket 300 by rotating the pin 200 relative to the cuff 322.

With continued reference to FIG. 4B, the safety interlock 104 remains engaged. For the illustrated embodiment, this corresponds to the inner flange 338 of the cuff 322 preventing the leading flange 220 of the pin 200 from forcing the ball bearings 306 radially outward. In this way, the safety interlock 104 resists the pin 200 being dislodged from the socket 300 should an explosion occur within the electrical connector assembly 100 as the pin conductor 202 is withdrawn from the interface unit 310 of the socket 300. The flame-extinguishing path 106 also remains in place during the decoupling of the contact coupling 102, which in the illustrated embodiment corresponds to the leading flange 220 sliding along the inner surface of the sleeve 324 as the external thread 204 of the pin 200 is unthreaded from the internal thread 304 of the cuff 322. Because the flame-extinguishing path 106 remains in place during decoupling of the pin conductor 202 and the socket conductor 302, expanding gases from an internal explosion during decoupling can be cooled, flames from the explosion can be quenched, and the expanding gases from the explosion can escape to the outside environment. In various embodiments, in the first disengaged state, the ball bearings 306 provide a physical interface that inhibits disengagement of the pin 200 from the socket 300. For example, as shown, the ball bearings 306 can engage against the leading flange 220 of the pin 200, thereby inhibiting the pin 200 from moving to disconnect with the socket 300 (e.g., in a downward direction in FIG. 4B).

FIG. 4C shows the electrical connector assembly 100 in a second disengaged state, such as when it is almost fully disconnected. In the embodiment shown, the safety interlock 104 has been disengaged. In the illustrated embodiment, this corresponds to removing the set screw 326 from the annular groove 328 and/or sliding the cuff 322 toward the interface unit 310. The cuff 322 can be slid until the cuff 322 strikes the shoulder 332 of the sleeve 324, thereby aligning the release groove 344 of the cuff 322 with the ball bearings 306. This can enable the ball bearings 306 to move radially outward, thereby removing the physical interface with the pin 200. In some embodiments, the leading flange 220 of the pin 200 can now be drawn past the ball bearings 306, which are forced radially outward into the release groove 344 by the leading flange 220. The pin 200 is now free to be completely withdrawn from the socket 300 (e.g., in a downward direction in FIG. 4C).

To assemble the electrical connector assembly 100, the process shown in FIGS. 4A-C can be reversed. The safety interlock 104 can be disengaged by moving the cuff 322 to sit against the shoulder 332 of the sleeve 324, thereby aligning the release groove 344 with the ball bearings 306 so that the ball bearings 306 can move radially outward to allow the leading flange 220 of the pin 200 to move toward the interface unit 310 of the socket 300 (FIG. 4C). The spring 334 can return the cuff 322 to a rest position that aligns the inner flange 338 with the ball bearings 306 so that the inner flange 338 forces the ball bearings 306 into the capture groove 206 of the pin 200 (FIG. 4B). The flame-extinguishing path 106 can be established by an annular clearance 108 between the leading flange 220 of the pin 200 and the inner surface of the sleeve 324 (FIG. 4B). The contact coupling 102 can then be engaged by threading the external thread 204 of the pin 200 onto the internal thread 304 of the socket 300 to advance the pin conductor 202 into the interface unit 310 of the socket 300, thereby establishing an electrical connection between the pin conductor 202 and the socket conductor 302 (FIG. 4A).

Figure 4D:
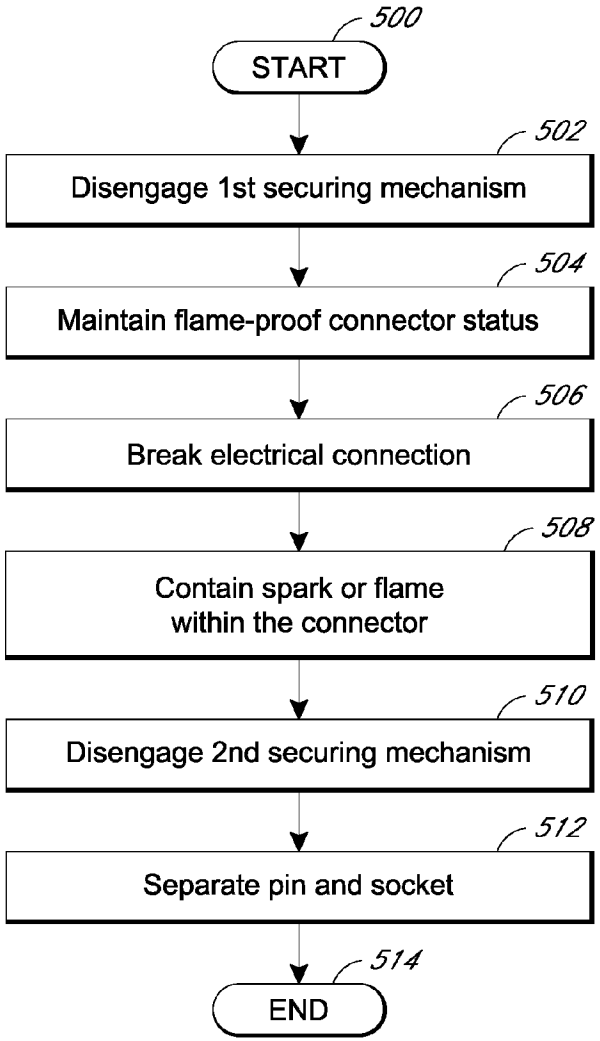
FIG. 4D is a schematic illustration of a method of disengaging a connector.

FIG. 4D shows a block diagram of a non-limiting, illustrative method of disconnecting the electrical connector assembly 100. In a starting step 500, the connector 100 can be in starting state that has a first securing mechanism (e.g., coupling contact 102) and a second securing mechanism (e.g., safety interlock 104) engaged. A first disengagement step 502 can be performed to disengage the first securing mechanism (e.g., unthreading the threads 204, 304). A flame-proof step 504 can maintain the flame-proof connector status after the first disengagement step 502 has been performed. For example, the flame-proof step 504 can comprise maintaining the narrows 107 at a clearance 108 of about a maximum of 0.002 inches across a longitudinal length of about a minimum of 0.25 inches. An electrical disconnection step 506 can be performed to break the electrical connection between the pin 200 and the socket 300. A containment step 508 can be performed to contain an explosion inside the connector. A second disengagement step 510 can be performed to disengage the second securing mechanism (e.g., safety interlock 104). A separation step 512 can be performed to separate the pin 200 and the socket 300. In an end step 514, the pin 200 and the socket 300 can be disconnected from one another.

Figure 5A:
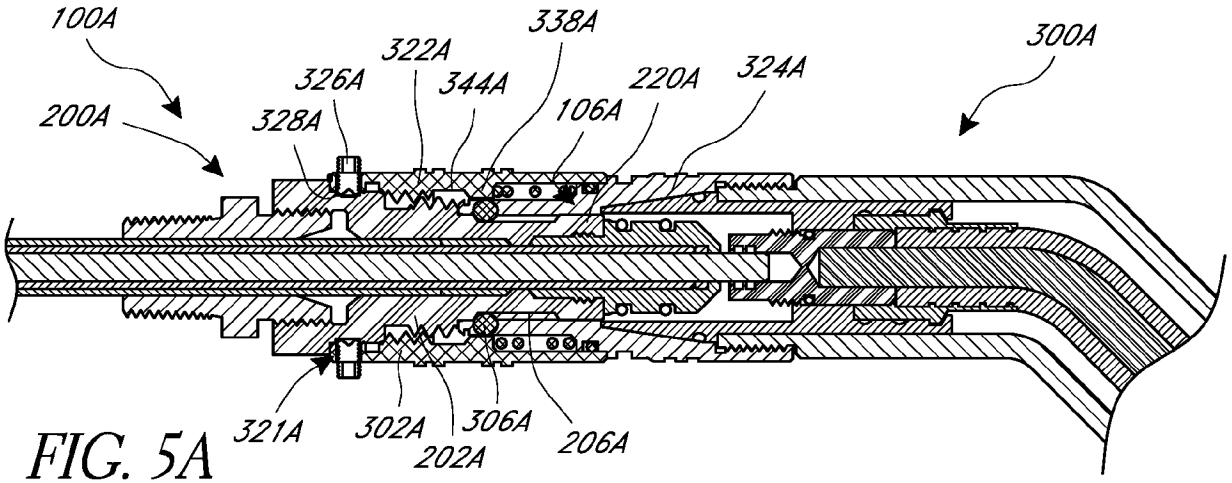
FIG. 5A is a side cross-sectional view of another embodiment of an electrical connector assembly comprising a pin and a socket.
Figure 5B:
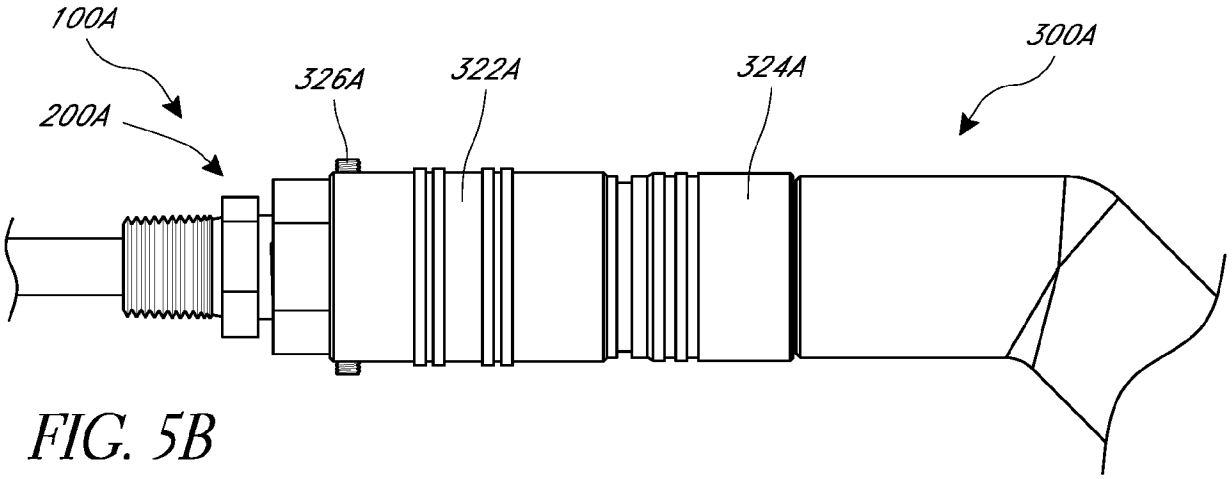
FIG. 5B is a side view of the electrical connector assembly shown in FIG. 5A.

FIG. 5A depicts another embodiment of an electrical connector assembly 100A. The assembly 100A is similar or identical to the electrical connector assembly 100 in many respects. Indeed, the assembly 100A can include any of the features of the assembly 100. The features of the electrical connector assembly 100A can be combined or included with the electrical connector assembly 100 or any other embodiment discussed herein. FIGS. 5A and 5B show the electrical connector assembly 100A in an assembled state. FIG. 5A shows a cross-sectional view of the electrical connector assembly 100A. FIG. 5B shows a side view of the electrical connector assembly 100A shown in FIG. 5A.

Referring to FIG. 5A, the electrical connector assembly 100A can have an annular groove 328A that is disposed on an outside surface of the pin 200. A set screw 326A can extend through a set screw hole 321A in a cuff 322A and can extend into the annular groove 328A. The cuff 322A can have an inner flange 338A that longitudinally aligns with the ball bearings 306A when the set screw hole 321A is longitudinally aligned with the annular groove 328A. In some embodiments, the inner flange 338A can secure (e.g., hold) the ball bearings 306A in the capture groove 206A of the pin 200A, such as when the set screw hole 321A is longitudinally aligned with the annular groove 328A. As can be seen in FIG. 5A, in some embodiments, the external thread 202 is substantially or fully mated with the internal thread 302 in order to longitudinally align the set screw hole 321A with the annular groove 328A. In certain variants, the cuff 322A is longitudinally and/or rotationally fixed relative to the pin 200 when the set screw 326A is seated in the annular groove 328A. In some implementations, to remove the pin 200A from the socket 300A, the set screw 326A is removed from the annular groove 328A.

Certain embodiments are configured such that, after removal of the set screw 326A from the annular groove 328A, the pin 200A can move longitudinally and rotationally with respect to the cuff 322A. The pin 200A can be rotated relative to the cuff 322A in order to unthread the external thread 202A from the internal thread 302A. As the external and internal threads 202A, 302A are unthreaded from one another, the leading flange 220A can be configured to slide along the inner surface of the sleeve 324A. Certain variants are configured to provide and/or maintain the flame-extinguishing path 106A between the leading flange 220A and the inner surface of the sleeve 324A, such as during unthreading of the threads 204A, 304A.

In some embodiments, the safety interlock 104A remains engaged (and/or is not disengaged) until after the contact coupling 102A has been partially or completely disengaged. For example, in some variants, the leading flange 220A cannot move longitudinally beyond (e.g., to the left in FIG. 5A) the ball bearing 306A unless the release groove 344A is aligned with the ball bearing 306A. In certain implementations, the release groove 344A and the leading flange 220A are configured to be longitudinally aligned with the ball bearings 306A when the internal thread 302A of the cuff 322A is partially or completely detached from the external thread 202A on the pin 200A.

Figure 6A:
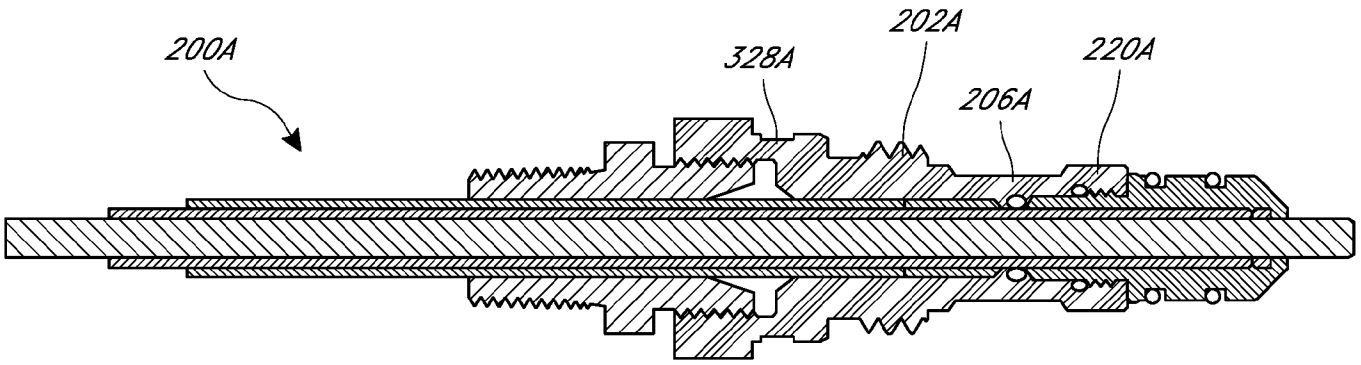
FIG. 6A is a side cross-sectional view of the pin shown in FIG. 5A.
Figure 6B:
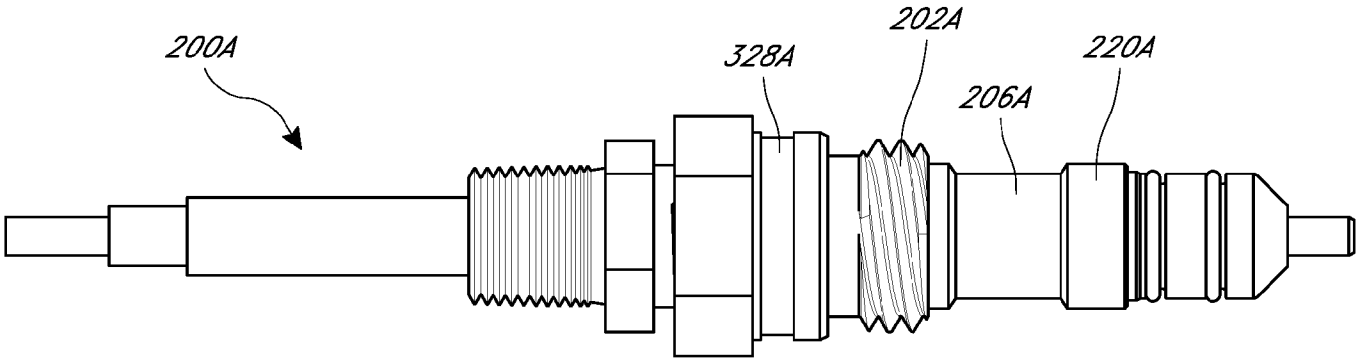
FIG. 6B is a side view of the pin shown in FIG. 5A.

FIG. 6A depicts a cross-sectional view of the pin 200A shown in FIG. 5A. FIG. 6B shows a side view of the pin 200A shown in FIG. 6A. FIGS. 6A and 6B show an example of the annular groove 328A, the external thread 202A, the capture groove 206A, and the leading flange 220A for an embodiment of the pin 200A. In the illustrated embodiment, the annular groove 328A that receives the set screw is disposed on the pin 200A.

Figure 7A:
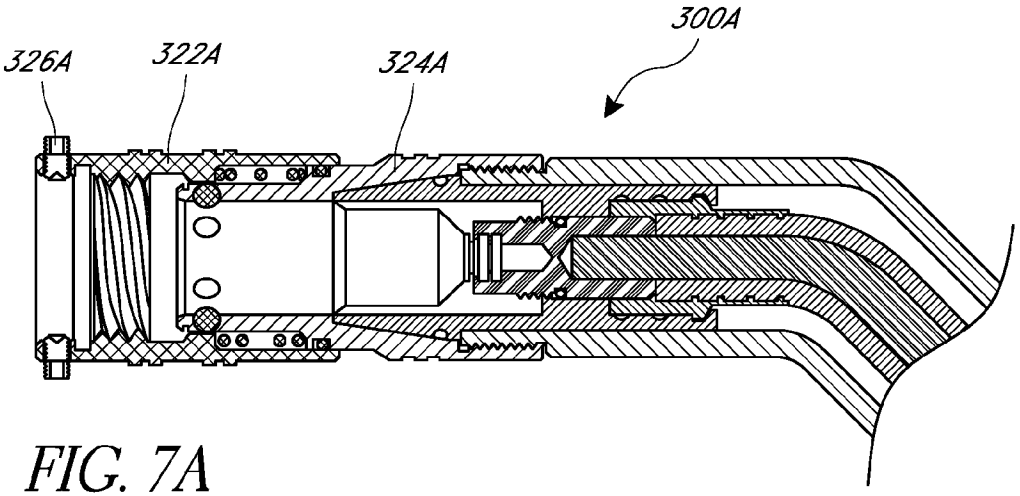
FIG. 7A is a side cross-sectional view of the socket shown in FIG. 5A.
Figure 7B:
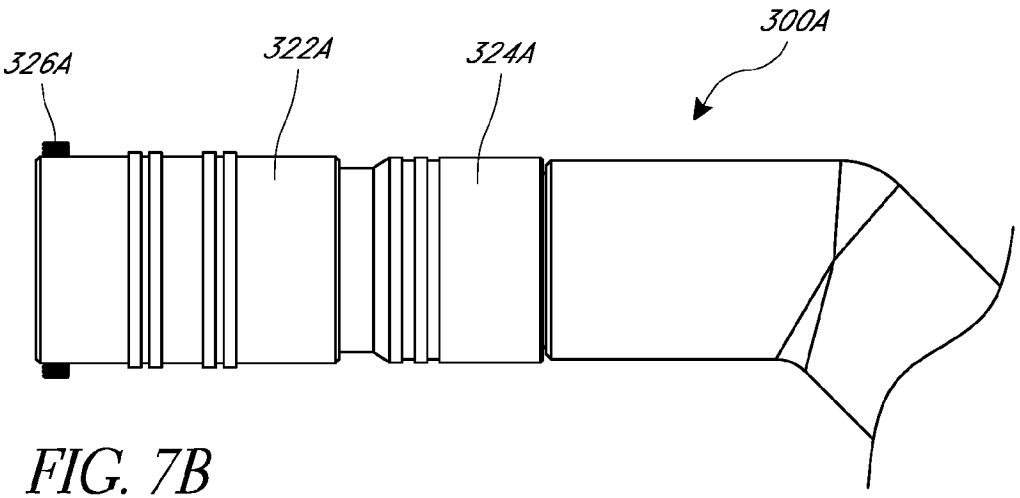
FIG. 7B is a side view of the socket shown in FIG. 5A.

FIG. 7A depicts a cross-sectional view of the socket 300A shown in FIG. 5A. FIG. 7B shows a side view of the socket 300A shown in FIG. 7A. FIGS. 7A and 7B show an example of the set screw 326A, the cuff 322A, and the sleeve 324A for an embodiment of the socket 300A.

Figure 8A:
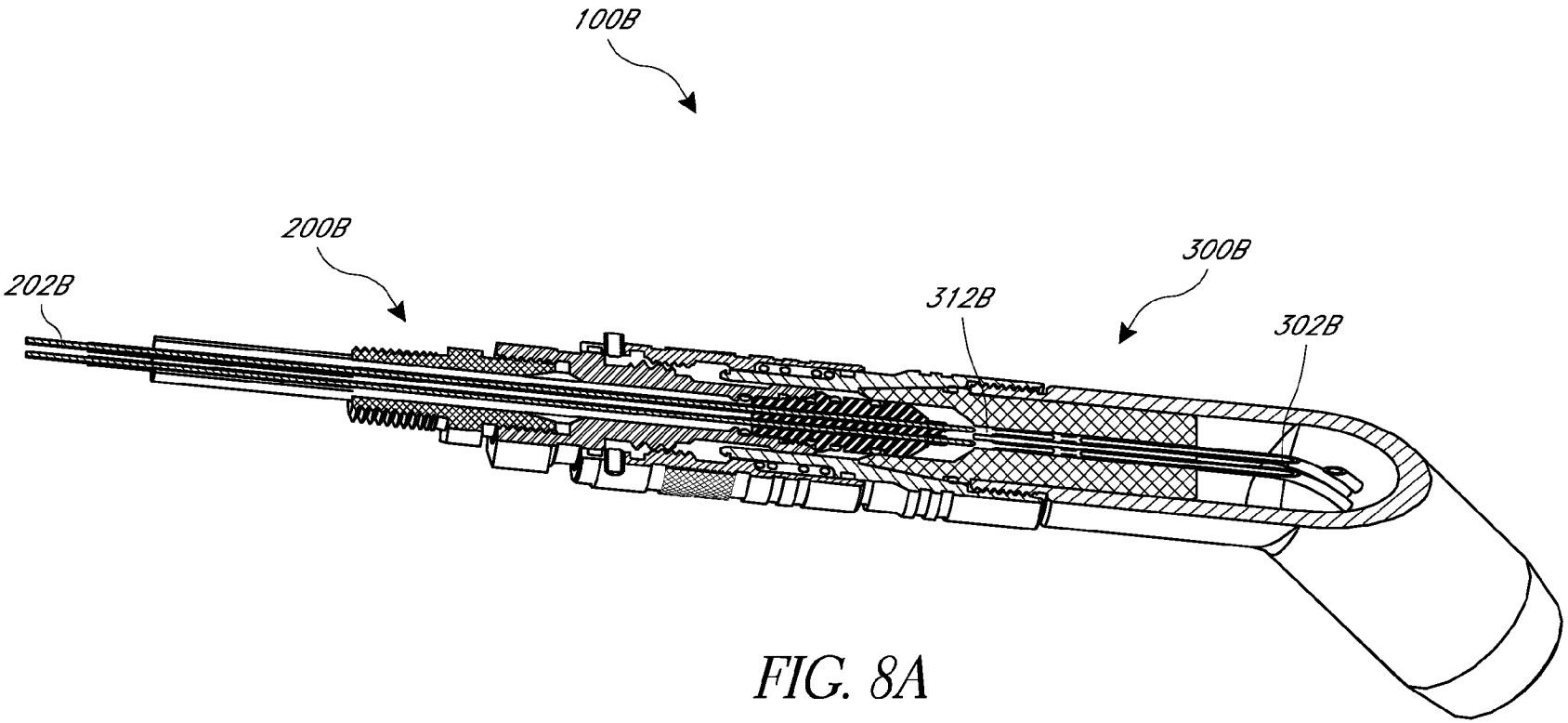
FIG. 8A is a partial cross-sectional view of an embodiment of an electrical connector assembly having multiple conductors.
Figure 8B:
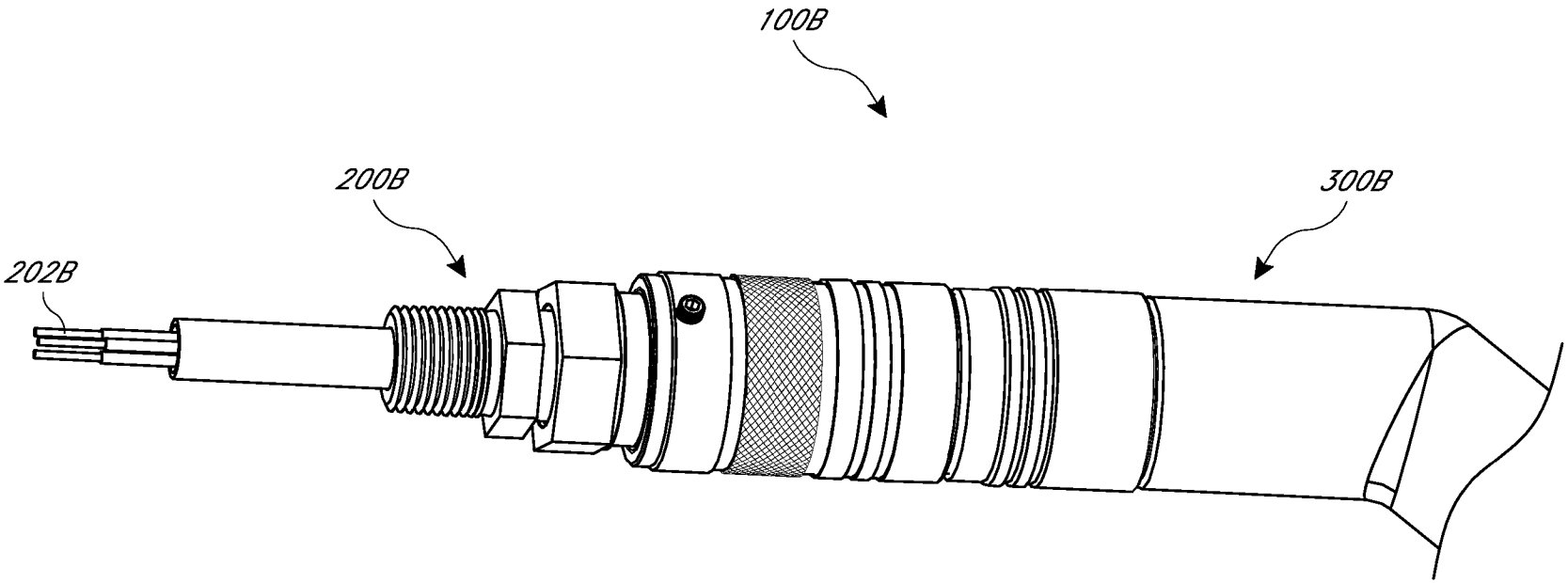
FIG. 8B is a side view of the electrical connector assembly of FIG. 8A.

FIG. 8A depicts another embodiment of an electrical connector assembly 100B. The assembly 100B is similar or identical to the other electrical connector assemblies 100, 100A in many respects. Indeed, the assembly 100B can include any of the features of the assembly 100 and/or the assembly 100A. The features of the electrical connector assembly 100B can be combined or included with the assembly 100, the assembly 100A, or any other embodiment discussed herein. FIG. 8A shows a cross-sectional view of the electrical connector assembly 100B. FIG. 8B shows a side view of the electrical connector assembly 100B.

The electrical connector assembly 100B can be configured to connect multiple elements, such as multiple electrical conductors. In the embodiment shown in FIGS. 8A and 8B, the electrical connector assembly 100B includes a pin 200B and a socket 300B. The pin 200B can connect to a plurality (e.g., two, three, or more) of pin conductors 202B and the socket 300B can connect to a corresponding number (e.g., two, three, or more) of socket conductors 302B. In the illustrated embodiment, the pin 200B has three pin conductors 202B and the socket 300B has three corresponding socket conductors 302B. The conductors 202B, 302B can be arranged in a generally triangular pattern in the pin 200B and socket 300B, respectively. The socket conductors 302B can each terminate in a respective port 312B of the socket 300B. The ports 312B of the socket 302B can be arranged to align with the pin conductors 202B when the electrical connector assembly 100B is assembled. In some embodiments, each of the pin conductors 202B establishes an electrical connection with a corresponding socket conductor 302B when the electrical connector assembly 100B is assembled. Various arrangements of the pin and socket conductors 202B, 302B are contemplated. For example, the pin and socket conductors 202B, 302B can be arranged in an array (e.g., 1-by-3 array, 3-by-3 array, 2-by-5 array, etc.).

Certain Terminology

Although the connector assemblies have been disclosed in the context of certain embodiments and examples, it will be understood by those skilled in the art that the assemblies extend beyond the specifically disclosed embodiments to other alternative embodiments and/or uses of the embodiments and certain modifications and equivalents thereof. Use with any structure is expressly within the scope of this invention. Various features and aspects of the disclosed embodiments can be combined with or substituted for one another in order to form varying modes of the assembly. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Terms of orientation used herein, such as "top," "bottom," "proximal," "distal," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Some embodiments have been described in connection with the accompanying drawings. The figures are to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

SUMMARY

In summary, various embodiments and examples of connector assemblies have been disclosed. Although the assemblies have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

The following is claimed:

1. A flame-proof electrical connector assembly comprising:

a pin comprising:

a first conductor;

a leading flange; and an outer surface comprising an external thread and an annular groove;

a socket comprising:

a second conductor that is configured to engage with the first conductor to provide electrical communication therebetween;

an internal thread configured to mate with the external thread of the pin, wherein an outer surface of the leading flange forms a flame-extinguishing path with an inner surface of the socket when the external thread mates with the internal thread; and a ball bearing extending radially inward of an inner surface of the socket;

wherein the internal and external threads form a first securing mechanism;

wherein the annular groove and the ball bearing form a second securing mechanism;

wherein the connector is configured such that:

in response to disengagement of the first securing mechanism, the pin and socket are moved relative to each other thereby disconnecting electrical communication between the first and second conductors while maintaining the engagement of the second securing mechanism; and in response to disengagement of the second securing mechanism, the pin and socket are separable from each other.

2. The electrical connector assembly of claim 1, wherein the socket further comprises a cuff and a sleeve, the cuff circumferentially surrounding at least a portion of the sleeve, the cuff being longitudinally and rotationally moveable relative to the sleeve.

3. The electrical connector assembly of claim 2, wherein the sleeve comprises the ball bearing, the ball bearing being aligned with an aperture having a diameter that is smaller than a diameter of the ball bearing.

4. The electrical connector assembly of claim 3, wherein the cuff comprises an inner flange and a through hole, the inner flange disposed on an inner surface of the cuff and adapted to longitudinally align with the ball bearing when the through hole is longitudinally aligned with a groove disposed on an outer surface of the sleeve.

5. The electrical connector assembly of claim 4, wherein the cuff further comprises a release groove disposed on the inner surface of the cuff, the release groove having an inner diameter that is larger than an inner diameter of the inner flange.

6. The electrical connector of claim 5, wherein the release groove is interposed between the inner flange and the internal thread.

7. The electrical connector assembly of claim 4, wherein a portion of the leading flange and a portion of a trailing flange radially overlap a portion of the ball bearing when the inner flange is longitudinally aligned with the ball bearing.

8. The electrical connector assembly of claim 7, wherein the socket further comprises an interface unit in electrical communication with a socket conductor, the interface unit being adapted to receive at least a portion of a pin conductor, the interface unit establishing an electrical connection between the pin conductor and the socket conductor when the at least a portion of the pin conductor is received in the interface unit.

9. The electrical connector of claim 8, wherein the interface unit receives the at least a portion of the pin connector when the external thread is fully advanced along the internal thread.

10. The electrical connector assembly of claim 2, further comprising a spring that compresses when the cuff is moved to cover a greater portion of the sleeve.

11. A flame-proof electrical connector assembly comprising:

a pin comprising:

a first conductor;

a first contact coupling portion;

a first safety interlock portion; and a first flame-extinguishing path portion;

a socket comprising:

a second conductor;

a second contact coupling portion, the second contact coupling portion being configured to mate with the first contact coupling portion;

a second safety interlock portion, the second safety interlock configured to mate with the first safety interlock portion; and a second flame-extinguishing path portion, the second flame-extinguishing path portion configured to mate with the first flame-extinguishing path portion;

the electrical connector assembly being configured such that:

when the first and second contact coupling portions are mated, the first and second conductors are in electrical communication;

when the first and second safety interlock portions are mated, the first and second flame-extinguishing path portions together form region for extinguishing a flame within the electrical connector; and the first and second contact coupling portions are fully unmated before the first and second safety interlock portions begin mating.

12. The electrical connector assembly of claim 11, wherein the first and second contact coupling portions comprise mating threads, and wherein the first and second safety interlock portions comprise a ball that mates with a groove.

13. The electrical connector assembly of claim 11, wherein, when the first and second contact coupling portions are unmated, the pin is axially movable relative to the socket.

14. The electrical connector assembly of claim 11, wherein, when the first and second contact coupling portions are unmated, the first and second conductors spaced apart thereby severing the electrical communication.

15. A method of disconnecting a flame-proof electrical connector that comprises a pin and a socket, the method comprising:

severing electrical communication between a conductor of the pin and a conductor of the socket, wherein severing electrical communication between the conductors comprises:

disengaging a first securing mechanism of the electrical connector;

automatically, in response to disengaging the first securing mechanism, spacing apart the conductor of the pin from the conductor of the socket;

maintaining a second securing mechanism in an engaged state such that the pin and socket are held together; and maintaining a flame-extinguishing path within the electrical connector; and after severing electrical communication between the conductors, disengaging the second securing mechanism of the electrical connector; and separating the pin and the socket.

16. The method of claim 15, wherein disengaging a first securing mechanism of the electrical connector comprises unthreading mated threads on the pin and socket.

17. The method of claim 15, wherein disengaging the second securing mechanism comprises releasing a physical interference between the pin and socket.

18. The method of claim 17, wherein the physical interference comprises a ball in a recessed channel.

19. The method of claim 15, wherein severing electrical communication between the conductors comprises further comprises forming a flame path between the pin and the socket by mating a flame-extinguishing path on the pin with a corresponding flame-extinguishing path on the socket.

20. The method of claim 15, further comprising removing a set screw.

* * * * *